US007478852B1

(12) United States Patent
Durden

(10) Patent No.: US 7,478,852 B1
(45) Date of Patent: Jan. 20, 2009

(54) LIFTING BEAM

(76) Inventor: P. Trentis Durden, 948 Oakpoint Cir., Apopka, FL (US) 32712

( * ) Notice: Subject to any disclaimer, the term of this patent is extended or adjusted under 35 U.S.C. 154(b) by 0 days.

(21) Appl. No.: 10/830,231

(22) Filed: Apr. 22, 2004

Related U.S. Application Data

(63) Continuation-in-part of application No. 10/402,317, filed on Mar. 28, 2003, now abandoned.

(51) Int. Cl.
*B66C 1/10* (2006.01)

(52) U.S. Cl. ..... 294/81.2; 294/81.3; 294/81.5

(58) Field of Classification Search ..... 294/81.2, 294/81.3, 81.54, 81.1, 81.5, 81.62, 81.4
See application file for complete search history.

(56) References Cited

U.S. PATENT DOCUMENTS

| | | | | | |
|---|---|---|---|---|---|
| 1,516,973 | A | | 11/1924 | Loughran | |
| 1,723,086 | A | * | 8/1929 | Smith | 294/81.5 |
| 1,745,049 | A | | 1/1930 | Systrom | |
| 2,372,478 | A | * | 3/1945 | Farr et al. | 294/87.1 |
| 2,721,757 | A | | 10/1955 | Anderson | |
| 2,961,269 | A | | 11/1960 | Renfroe | |
| 3,002,779 | A | * | 10/1961 | Frate et al. | 294/67.33 |
| 3,314,711 | A | * | 4/1967 | Dietz et al. | 294/67.5 |
| 3,343,861 | A | | 9/1967 | Sinicki | |
| 3,458,229 | A | * | 7/1969 | Cooper et al. | 294/81.2 |
| 3,547,478 | A | * | 12/1970 | Pradon | 294/81.21 |
| 3,561,810 | A | | 2/1971 | Newsted | |
| 3,865,422 | A | | 2/1975 | Archer | |
| 4,010,971 | A | | 3/1977 | Kuwamoto et al. | |
| 4,035,010 | A | | 7/1977 | Kawashita et al. | |
| 4,114,765 | A | * | 9/1978 | Kojima | 414/756 |
| 4,240,660 | A | | 12/1980 | Roth et al. | |
| 4,293,155 | A | * | 10/1981 | Grant | 294/75 |
| 4,685,714 | A | | 8/1987 | Hoke | |
| 4,799,724 | A | | 1/1989 | Rekers | |
| 5,092,529 | A | | 3/1992 | Bechler et al. | |
| 5,297,832 | A | | 3/1994 | Dewey | |
| 5,411,306 | A | | 5/1995 | Campbell et al. | |
| 5,522,633 | A | * | 6/1996 | Massi | 294/81.52 |
| 5,820,184 | A | * | 10/1998 | Echenay | 294/81.2 |

FOREIGN PATENT DOCUMENTS

| | | | |
|---|---|---|---|
| DK | 0109753 | * | 6/1968 |
| FR | 1480384 | * | 5/1957 |
| GB | 1120049 | * | 7/1968 |

* cited by examiner

*Primary Examiner*—Dean J Kramer
(74) *Attorney, Agent, or Firm*—Allen, Dyer, Doppelt, Milbrath & Gilchrist, P.A.

(57) ABSTRACT

A lifting apparatus includes an I-beam having a lower flange and an upper flange; a plurality of hoist connectors positioned on the I-beam extending upwardly from the upper flange; a center load connector positioned on the I-beam extending downwardly from approximately a midpoint along the lower flange; and at least two movable load connectors positioned on the I-beam extending downwardly from the lower flange, each movable load connector engaged with the I-beam by a plurality of support members having one or more wheels positioned to roll along upper surfaces of the lower flange, the center load connector being positioned between the at least two movable load connectors. An associated method includes providing the lifting apparatus; connecting a lifting machine to at least one of the hoist connectors; connecting a load to at least one of the load connectors; and lifting the load by using the lifting machine.

26 Claims, 7 Drawing Sheets

LIFTING BEAM

RELATED APPLICATION

This application is a continuation-in-part of and claims priority from application Ser. No. 10/402,317, which was filed on Mar. 28, 2003, now abandoned and which is incorporated herein by reference in its entirety.

FIELD OF THE INVENTION

The present invention relates to the field of load lifting and, more particularly, to a lifting apparatus for use with a crane or other lifting machine.

BACKGROUND OF THE INVENTION

The lifting of heavy loads by use of a crane or other lifting machine is employed in various fields of endeavor, including construction, heavy industries, shipping, and others. Wide loads have always presented the difficulty of lifting the material so that it is relatively level in a desired orientation. Level lifting is required to allow easier positioning of the load material by the crane when the transfer is complete. For example, in the construction industry, it is important when lifting a manufactured wall to do so in a substantially level orientation, so that workers may more easily guide the wall into place as the crane or other lifting machine brings the load down.

One approach to providing relatively level lifting of such wide loads has been the use of a lifting beam, also known in the art as a spreader bar, and referred to herein as a lifting apparatus. A spreader bar is generally a steel beam, preferably an I-beam, having a hoist connector for a crane hook, the hoist connector being best structured so that when the spreader bar is lifted, the beam is held in a relatively horizontal position by the crane. Additionally, the spreader bar will also include load connectors which allow for connecting the spreader bar to a load so that the load hangs below the spreader bar as it is lifted. These load connectors are preferably positioned spread apart on the spreader bar so that the distance between them is adjustable to accommodate loads of various sizes. Typically, the spreader bar includes a series of holes spread apart along the beam. The load connectors are secured at a desired distance spread apart from each other, and are secured in place by a bolt or other fastener which is run through the hole in the spreader bar beam. In addition, the load connectors may have to be repeatedly repositioned during the work day to handle loads of varying sizes. Those skilled in the art will appreciate that this process for adjusting the spread of the load connectors along the spreader bar beam is slow and requires much manual labor.

With the foregoing in mind, the present invention discloses a lifting apparatus, or spreader bar, having load connectors, or load hooks, which are movably mounted along the spreader bar beam so that they can be easily repositioned according to need, and secured in place by tightening a fastener, or by positioning a "stop" along the track. As noted above, prior art spreader bars have a series of holes along their length and require that for repositioning the load hooks be first unbolted from their current position, moved, and then re-bolted into their new location, a procedure that is very time consuming.

SUMMARY OF THE INVENTION

With the foregoing in mind, the present invention advantageously provides a lifting apparatus comprising an I-beam having a lower flange and an upper flange; a plurality of hoist connectors positioned on the I-beam extending upwardly from the upper flange; a center load connector positioned on the I-beam extending downwardly from approximately a midpoint along the lower flange; and at least two movable load connectors positioned on the I-beam extending downwardly from the lower flange, each movable load connector engaged with the I-beam by a plurality of support members having one or more wheels positioned to roll along upper surfaces of the lower flange, the center load connector being positioned between the at least two movable load connectors.

A method aspect of the invention includes providing a lifting apparatus including an I-beam having a lower flange and an upper flange, a plurality of hoist connectors positioned on the I-beam extending upwardly from the upper flange, a center load connector positioned on the I-beam extending downwardly from approximately a midpoint along the lower flange, and at least two movable load connectors positioned on the I-beam extending downwardly from the lower flange, each movable load connector engaged with the I-beam by a plurality of support members having one or more wheels positioned to roll along upper surfaces of the lower flange, the center load connector positioned between the at least two movable load connectors. The method continues by connecting a lifting machine to at least one hoist connector of the plurality of hoist connectors and connecting a load to at least one of the load connectors. Finally, the method includes lifting the load by using the lifting machine to lift the lifting apparatus to thereby lift the load connected thereto. Thereafter, the method ends.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

Figure 1:
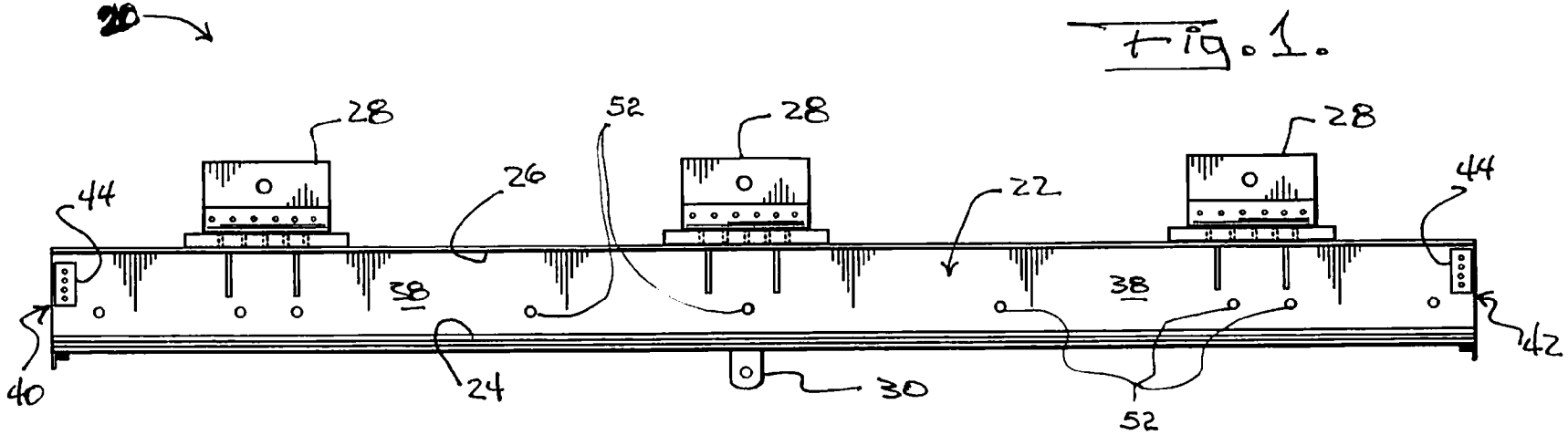
FIG. 1 is a side elevation view of a preferred embodiment of the lifting apparatus according to the present invention.

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, it should be understood that the materials, methods and examples given are illustrative in nature only and not intended to be limiting. Accordingly, this invention may be embodied in many different forms and should not be construed as limited to the illustrated embodiments set forth herein. Rather, the illustrated embodiments are provided solely for exemplary purposes so that this disclosure will be thorough and complete, and will fully convey the scope of the invention to those skilled in the art. Other features and advantages of the invention will be apparent from the following detailed description, and from the appended claims.

FIGS. 1 through 12 illustrate a lifting apparatus and its associated method according to the present invention. The lifting apparatus 20 comprises an I-beam 22 having a lower flange 24 and an upper flange 26. The I-beam 22 is preferably sturdier than a typical I-beam used in construction, although in general structure the present I-beam is substantially similar to a typical I-beam as known in the art. A plurality of hoist connectors 28 is positioned on the I-beam 22 extending upwardly from the upper flange 26. A center load connector 30 is positioned on the I-beam 22 extending downwardly from approximately a midpoint along the lower flange 24. At least two movable load connectors 32 are positioned on the I-beam 22 extending downwardly from the lower flange 24, each movable load connector engaged with the I-beam by a plurality of support members 34 having one or more wheels 36 positioned to roll along upper surfaces of the lower flange 24, the center load connector 30 being positioned between the at least two movable load connectors.

Figure 5:
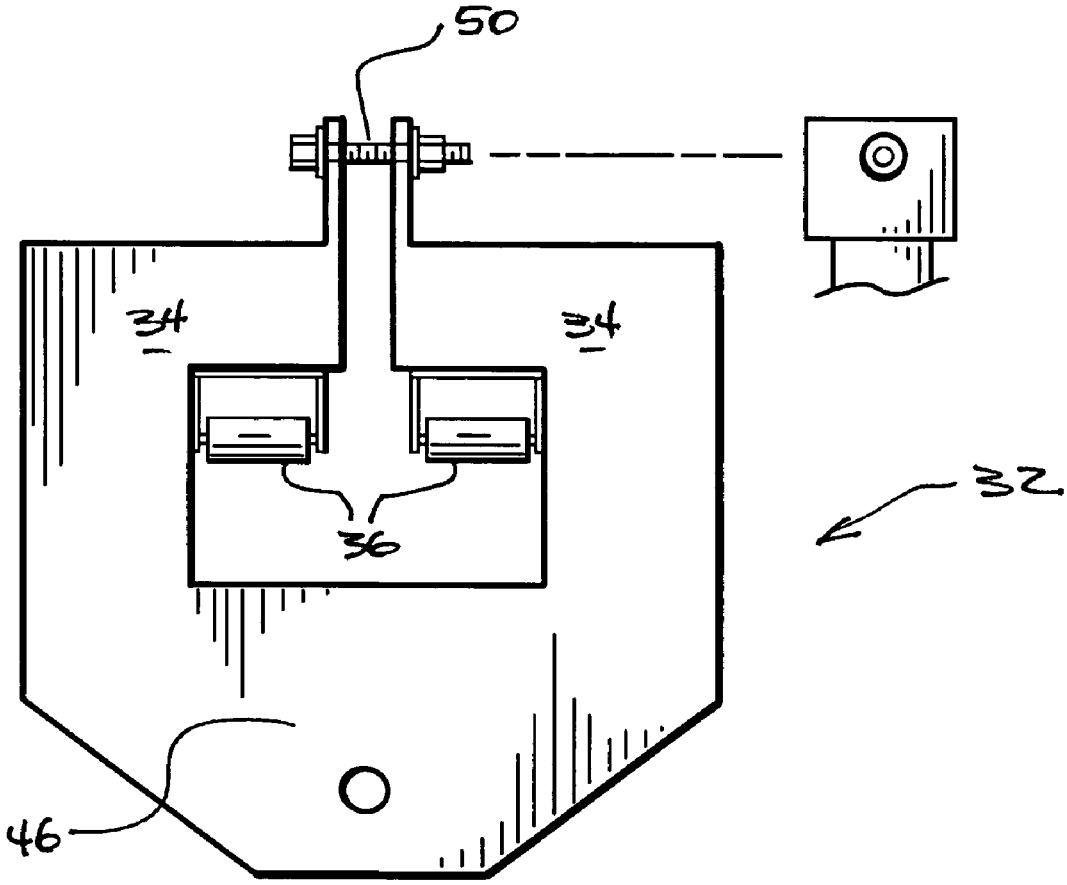
FIG. 5 depicts a front elevation view of a movable load connector shown in FIG. 1.
Figure 6:
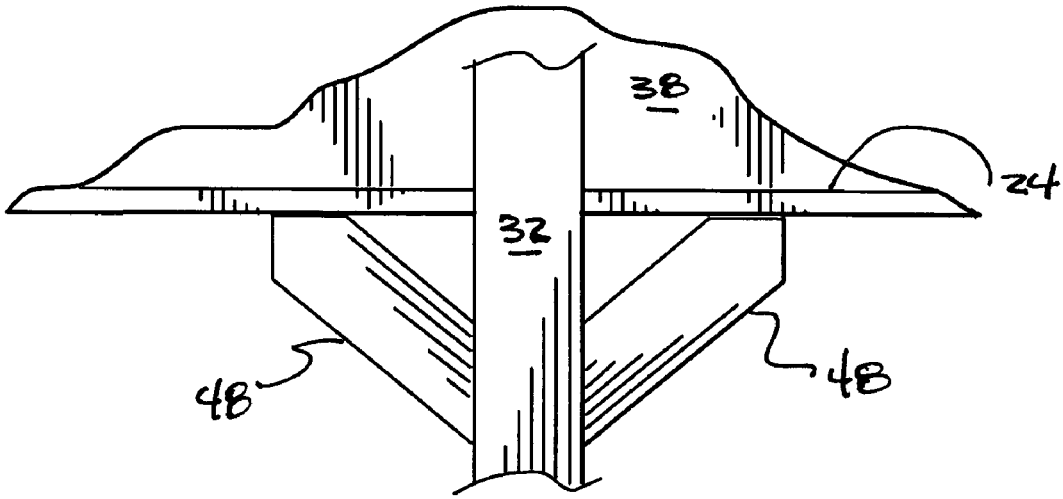
FIG. 6 is a fractional detail view of support members on the movable load connector of FIG. 3.
Figure 9:
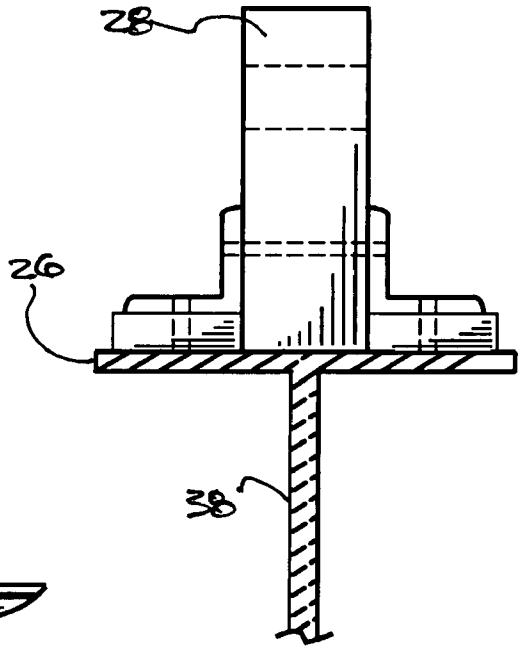
FIG. 9 is a side elevation view of the hoist connector of FIG. 7.
Figure 7:
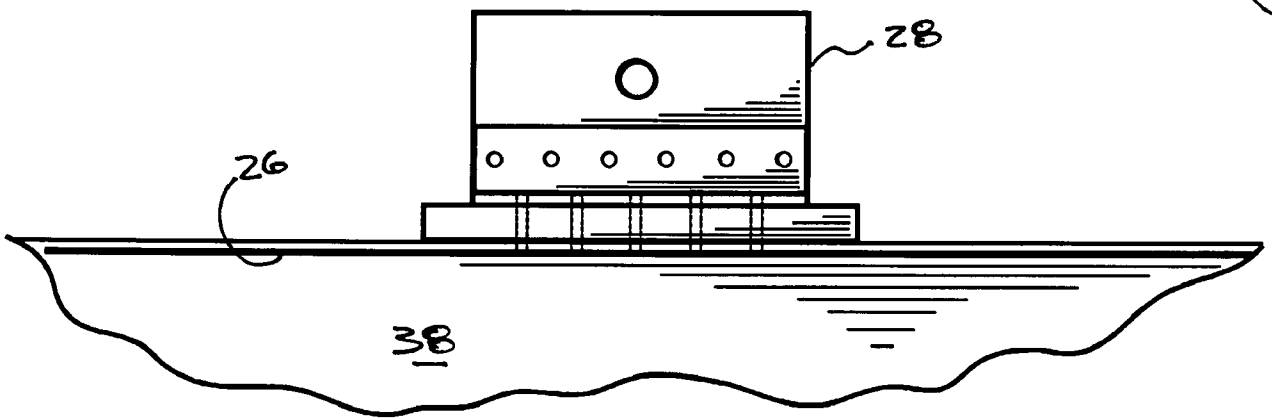
FIG. 7 shows a front elevation view of a hoist connector according to the invention of FIG. 1.
Figure 8:
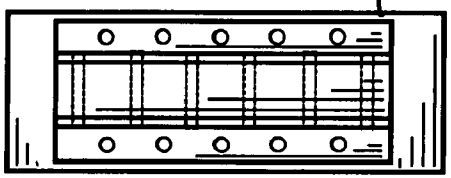
FIG. 8 is a top plan view of the hoist connector of FIG. 7.
Figure 11:
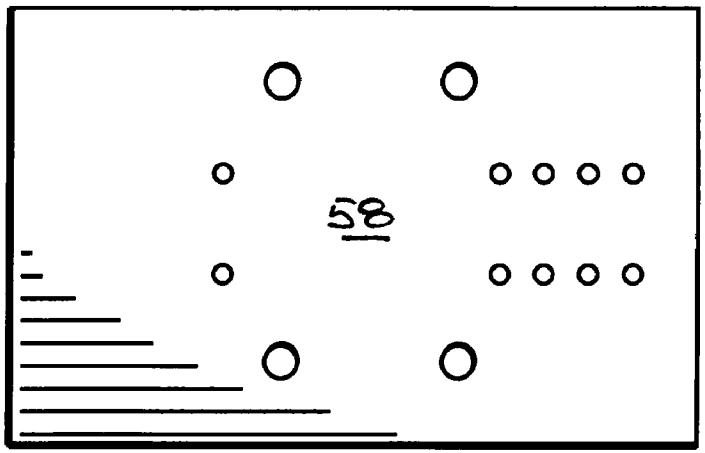
FIG. 11 shows a front elevation view of an end member serving as a leg for the embodiment of the invention as shown in FIG. 2.
Figure 10:
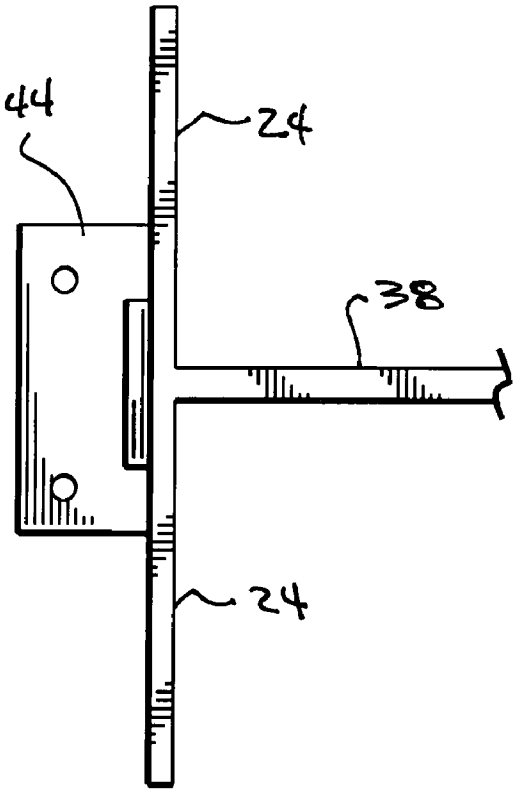
FIG. 10 depicts a front elevation view of a stop member positioned at the end of the lifting apparatus of FIG. 1.
Figure 12:
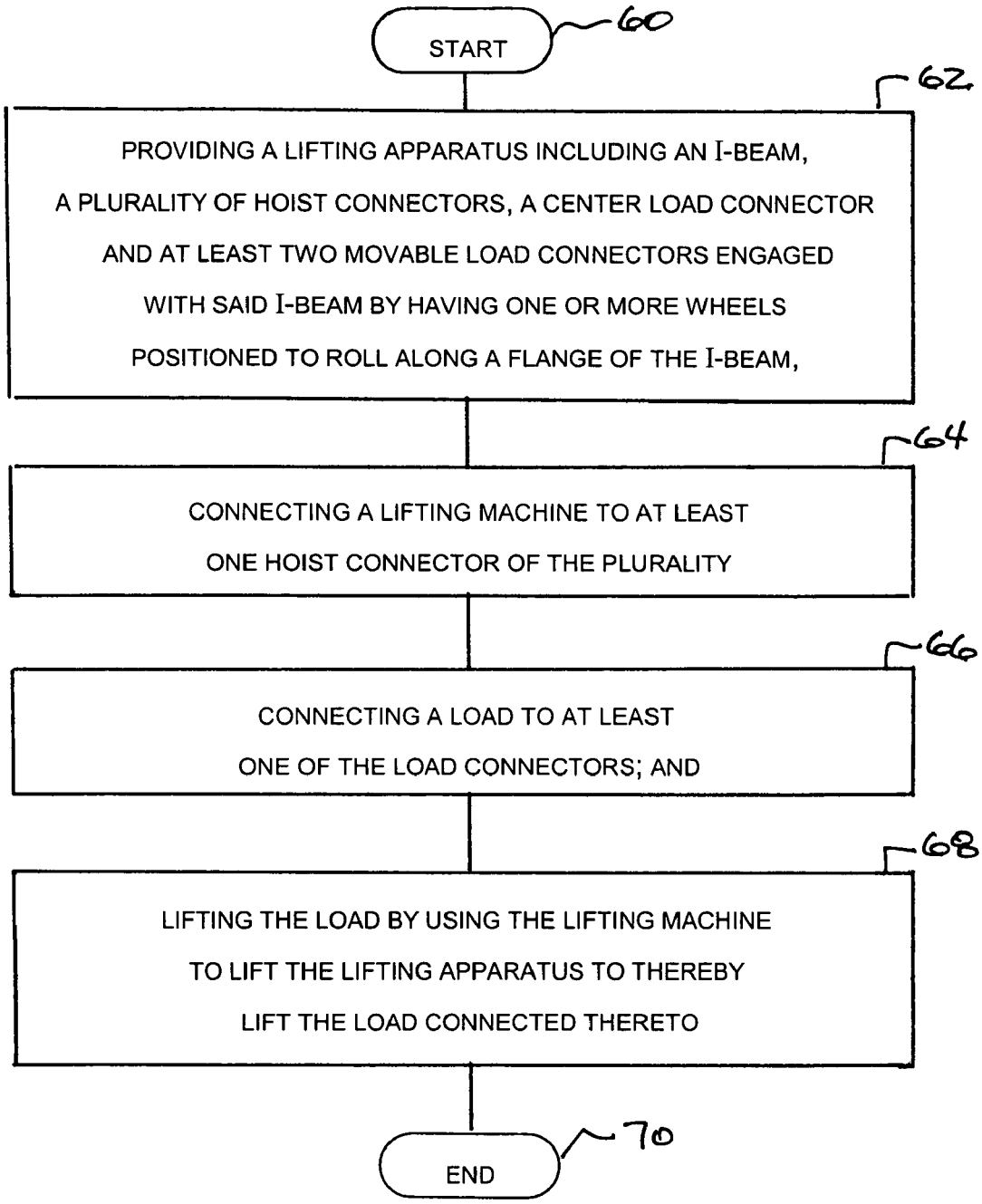
FIG. 12 is a block diagram illustrating the method of the invention.

It should be understood that while the term "wheel" may be used herein to describe a rolling member which allows easy repositioning of the movable load connectors along the I-beam, therefore, the invention is intended to include any other structure rendering this function, such as rollers, bearings, and the like, as shown in FIG. 5 by part reference number 36.

In another embodiment of the invention, the I-beam 22 has a lower flange 24, an upper flange 26, and an elongate generally planar main member 38 positioned between the lower and upper flanges and perpendicularly connected thereto. The I-beam 22 has a first end 40, a second end 42, and a predetermined lengthwise extent therebetween. The lower flange 24 extends approximately perpendicularly along two sides of a lower periphery of the lengthwise extent of the I-beam 22 and the upper flange 26 extends approximately perpendicularly along two sides of an upper periphery of the lengthwise extent of the I-beam.

Yet another embodiment of the invention includes an I-beam 22 having an elongate and approximately planar main member 38, and an elongate and approximately planar upper member 26 having a lengthwise extent and positioned so that an upper edge of the main member abuts the upper member along a an imaginary center line of the lengthwise extent of the upper member and the upper member is approximately perpendicular to the plane of the main member 38 thereby forming an upper flange extending along two upper sides of the main member. The I-beam 22 also includes an elongate and approximately planar lower member 24 having a lengthwise extent and positioned so that an lower edge of the main member 38 abuts the lower member along a an imaginary center line of the lengthwise extent of the lower member and the lower member is approximately perpendicular to the plane of the main member thereby forming a lower flange.

Additional features of the present invention will now be described with further reference to the figures. Preferably, the I-beam 22 further comprises one or more stop members 44 positioned on the I-beam to prevent the at least two movable load connectors 32 from disengaging from the I-beam. The one or more stop members 44 may comprise one or more angle members connected to the I-beam 22 adjacent the first and second ends.

The plurality of hoist connectors 28 comprises at least three hoist connectors, one of the at least three hoist connectors being preferably positioned centered on the I-beam 22 along the lower flange 24. The connectors, both hoist connectors 28 and at least one load connector 30 are preferably connected to the I-beam 22 by mechanical fasteners, but alternatively may be fixed to the I-beam by any effective means known in the art, for example, by being welded. Hoist connectors are best shown in FIGS. 1-2 and 7-9.

In the lifting apparatus 20, each of the movable load connectors 32, comprises a main body 46, two support members 34 extending upwardly from the main body to engage on the lower flange 24 of the I-beam 22 so that the main body of the movable load connector is supported thereby and extends downwardly from the I-beam 22. Each of the movable load connectors 32 further comprises at least one wheel 36 associated with each support member 34 and positioned to roll along an upper surface of the lower flange 24. Additionally, each movable load connectors 32 may include at least two stabilizing members extending upwardly from each the movable load connector and ending adjacent a lower surface of the lower flange 24. Preferably, the stabilizing members 48 extend upwardly from opposite sides of each movable load connector 32. The movable load connectors 32 may also include at least one mechanical fastener 50 associated with the support members 34, and the I-beam 22 includes a plurality of spaced apart openings 52 positioned along the I-beam to receive the mechanical fastener so as to thereby secure each the movable load connector at a predetermined position along the I-beam.

Figure 3:
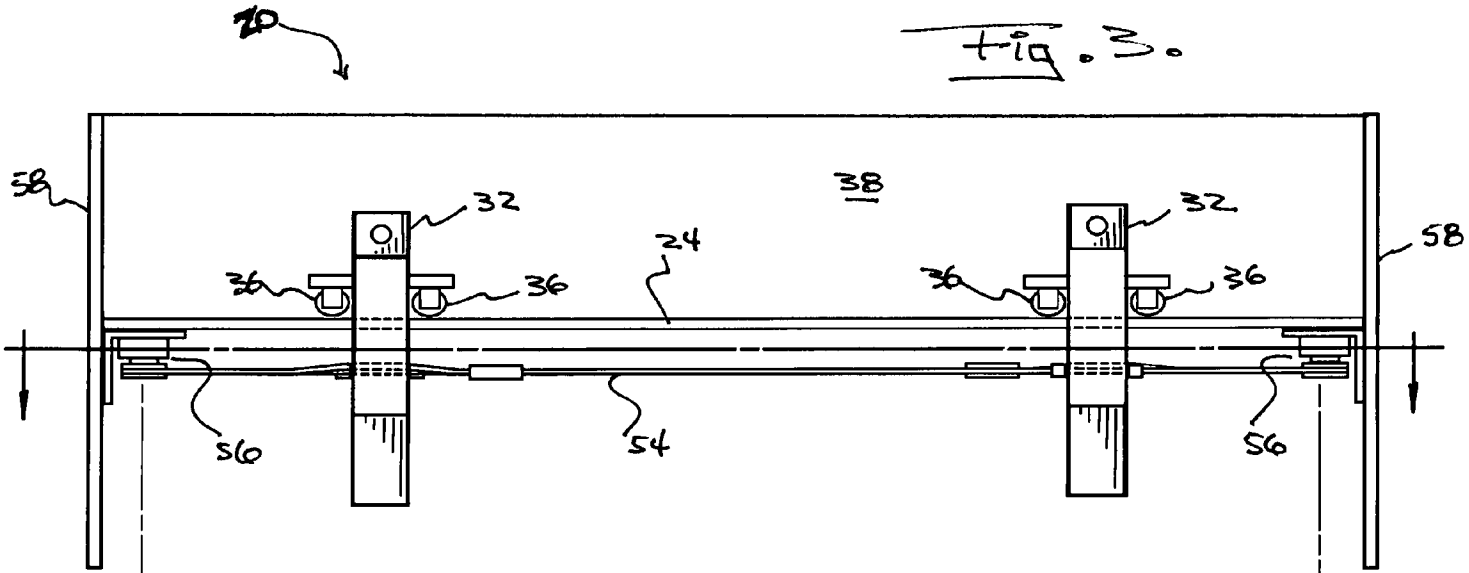
FIG. 3 shows a side elevation view of a third embodiment of the invention.
Figure 4:
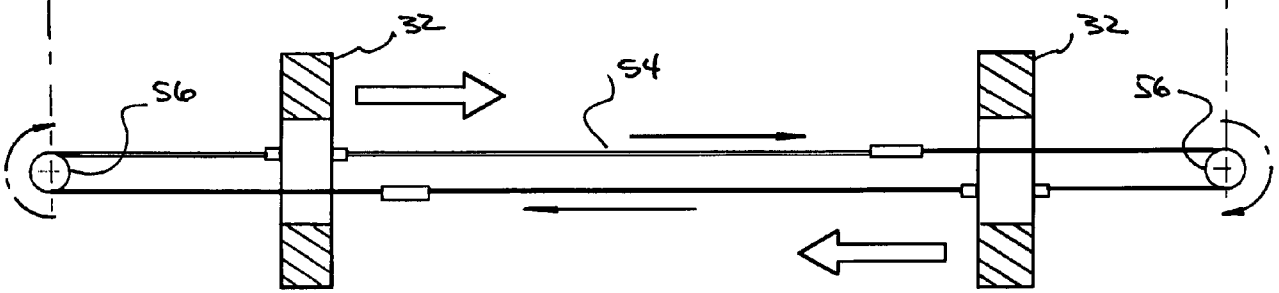
FIG. 4 is a top plan view of a cross section of the invention shown in FIG. 3.

Another embodiment of the lifting apparatus of the present invention is shown in FIGS. 3 and 4. In this embodiment, the lifting apparatus 20 includes at least two movable load connectors 32 associated with a continuous cable 54 which is guided through at least two pulleys 56 to thereby allow simultaneously positioning the movable load connectors along the I-beam 22.

Figure 2:
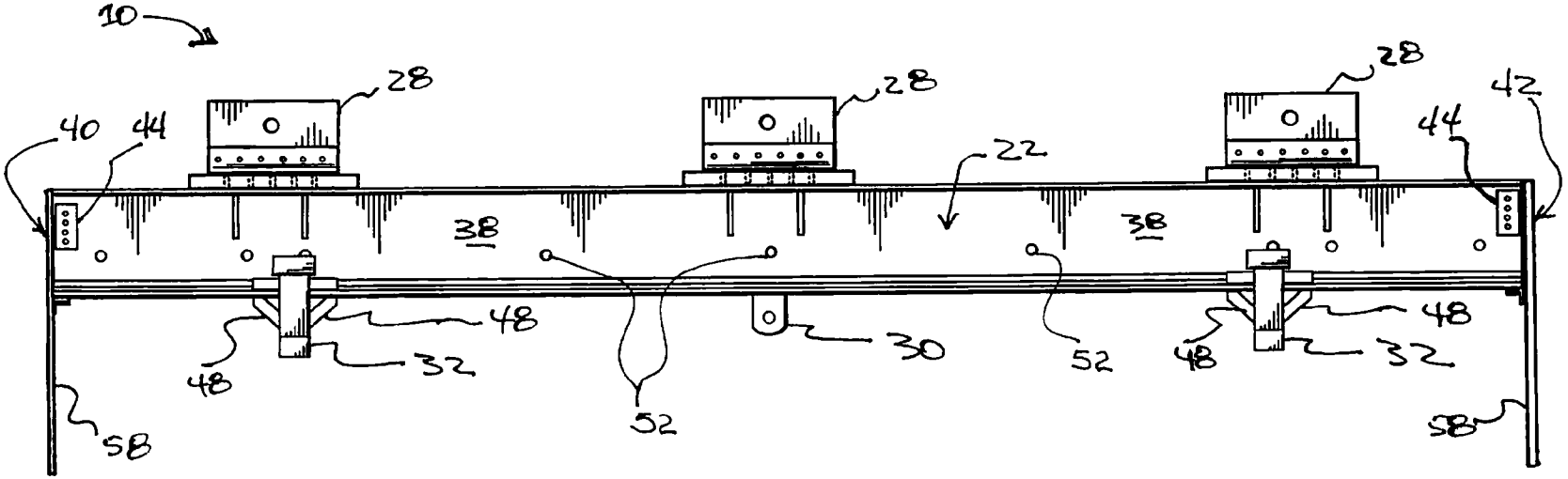
FIG. 2 shows an additional preferred embodiment of the invention of FIG. 1.

As shown in FIG. 2, the I-beam 22 further preferably may comprise two end members positioned at opposite ends of the I-beam, the two end members 58 extending an equal predetermined distance downwardly from the lower flange 24 to thereby provide two legs to support the lifting apparatus 20 upright upon a surface.

A method aspect of the invention includes lifting a load with the lifting apparatus described. From the start 60, the method includes providing 62 a lifting apparatus including an I-beam as described above. The method continues by connecting a lifting machine 64 to at least one hoist connector of the plurality of hoist connectors, and connecting a load 66 to at least one of the load connectors. The load is then lifted 68 by using the lifting machine to lift the lifting apparatus to thereby lift the load connected thereto. Thereafter, the method ends 70.

In the drawings and specification, there have been disclosed typical preferred embodiments of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A lifting beam comprising:

an I-beam having first and second ends, a lower flange and an upper flange extending between said first and second ends and having a plurality of spaced apart openings positioned along the I-beam;

three hoist connectors fixed to and extending upwardly from the upper flange, one of the three hoist connectors being at approximately a mid-point of said I-beam between the other two hoist connectors, which are equidistant therefrom:

a center load connector positioned on said I-beam extending downwardly from approximately a midpoint along the lower flange;

at least two movable load connectors positioned on said I-beam extending downwardly from the lower flange, each movable load connector engaged with said I-beam by a plurality of supports having one or more members positioned to roll along upper surfaces of the lower flange regardless of load borne by said at least two movable load connectors, and having at least one mechanical fastener associated with said plurality of supports, the at least one mechanical fastener being receivable in an individual opening of the plurality of spaced apart openings positioned along the I-beam to thereby secure each said movable load connector at a predetermined position along the I-beam, said center load connector being positioned between said at least two movable load connectors;

first and second stop members respectively positioned at the first and second ends of said I-beam to prevent said at least two movable load connectors from disengaging from said I-beam and extending sufficiently below the lower flange to form an angle with an underside of said lower flange;

at least two pulleys each positioned at the angle formed by an underside of said lower flange and one of said first and second stop members; and a continuous cable operably associated with said at least two pulleys and said at least two movable load connectors.

2. The lifting beam of claim 1, wherein said I-beam further first and second stop members extend downwardly from the lower flange sufficiently to function as support legs when said I-beam is lowered to a relatively flat surface.

3. The lifting beam of claim 2, wherein said at least one stop member comprises one or more angle members connected to said I-beam adjacent said first and second ends.

4. The lifting beam of claim 1, wherein said center load connector is connected to said I-beam by mechanical fasteners.

5. The lifting beam of claim 1, wherein said center load connector is fixed to said I-beam.

6. The lifting beam of claim 1, wherein said plurality of hoist connectors is connected to said I-beam by mechanical fasteners.

7. The lifting beam of claim 1, wherein each of said at least two movable load connectors comprises a main body, two support members extending upwardly from the main body to engage on the lower flange of said I-beam so that the main body of said movable load connector is supported thereby and extends downwardly from said I-beam.

8. A lifting beam comprising:

an I-beam having a lower flange, an upper flange, and an elongate main member positioned between said lower and upper flanges and perpendicularly connected thereto, said I-beam having a first end, a second end, and a predetermined lengthwise extent therebetween, said lower flange extending outwardly along two sides of a lower periphery of the lengthwise extent of the I-beam and said upper flange extending outwardly along two sides of an upper periphery of the lengthwise extent of the I-beam;

a plurality of hoist connectors extending upwardly from the upper flange of said I-beam;

a center load connector plate extending downwardly from approximately a midpoint of the lower flange of said I-beam and facing an imaginary plane defined by the main member;

at least two rolling load connectors extending downwardly from the lower flange of said I-beam, each movable load connector engaged with said I-beam by a plurality of rolling members positioned to roll along an upper surface of the lower flange, said center load connector positioned between said at least two rolling load connectors;

a plurality of spaced apart openings positioned along the main member of said I-beam to receive a mechanical fastener associated with each of said at least two rolling load connectors to thereby secure each at a predetermined position along the I-beam; and at least two pulleys borne on an underside of the lower flange and operably engaged with a continuous cable openly extending along said I-beam, said cable connected to said at least two rolling load connectors.

9. The lifting beam of claim 8, wherein said I-beam further comprises at least one stop member positioned on said I-beam to prevent said at least two movable load connectors from disengaging with said I-beam.

10. The lifting beam of claim 9, wherein said at least one stop member comprises one or more angle members connected to said I-beam adjacent said first and second ends.

11. The lifting beam of claim 8, wherein said plurality of hoist connectors comprises at least three hoist connectors, one of said at least three hoist connectors positioned centered along the lower flange of said I-beam.

12. The lifting beam of claim 8, wherein said plurality of hoist connectors is connected to said I-beam by mechanical fasteners.

13. The lifting beam of claim 8, wherein said center load connector is connected to said I-beam by mechanical fasteners.

14. The lifting beam of claim 8, wherein said center load connector is fixed to said I-beam.

15. The lifting beam of claim 8, wherein each of said at least two movable load connectors comprises a main body, two support members extending upwardly from the main body to engage on the lower flange of said I-beam so that the main body of said movable load connector is supported thereby and extends downwardly from said I-beam.

16. The lifting beam of claim 8, wherein the I-beam further comprises two end members positioned at opposite ends of said I-beam, said two end members extending an equal predetermined distance downwardly from the lower flange to thereby provide two legs to support the lifting beam upright upon a surface.

17. A lifting beam comprising:

an I-beam having an upper flange and a lower flange;

a plurality of hoist connector plates extending vertically upwardly from the upper flange of said I-beam along a center line of the upper flange;

a center load connector plate extending downwardly from the lower flange;

at least two rolling load connectors associated with the lower flange and extending downwardly therefrom, each supported by a plurality of rolling members positioned to roll along an upper surface of the lower flange regardless of load borne, said center load connector plate positioned between said at least two rolling load connectors; and at least two pulleys supporting a continuous cable along an underside of the lower flange of said I-beam, said cable connected to said at least two movable load connectors.

18. The beam of claim 17, wherein said I-beam further comprises at least one stop member positioned on said I-beam to prevent said at least two rolling load connectors from disengaging with said I-beam.

19. The lifting beam of claim 18, wherein said at least one stop member comprises one or more angle members connected to said I-beam adjacent said first and second ends.

20. The lifting beam of claim 17, wherein said plurality of hoist connectors comprises at least three hoist connectors, one of said at least three hoist connectors positioned centered along the lower flange of said I-beam.

21. The lifting beam of claim 17, wherein said plurality of hoist connectors is connected to said I-beam by mechanical fasteners.

22. The lifting beam of claim 17, wherein said center load connector is connected to said I-beam by mechanical fasteners.

23. The lifting beam of claim 17, wherein said center load connector is fixed to said I-beam.

24. The lifting beam of claim 17, wherein each of said at least two rolling load connectors comprises a main body, two support members extending upwardly from the main body to engage on the lower flange of said I-beam so that the main body of said rolling load connector is supported thereby and extends downwardly from said I-beam.

25. The lifting beam of claim 17, wherein each of said at least two rolling load connectors comprises at least one mechanical fastener associated with said plurality of support members, and wherein said I-beam comprises a plurality of spaced apart openings positioned along the I-beam to receive said at least one mechanical fastener to thereby secure each said rolling load connector at a predetermined position along the I-beam.

26. The lifting beam of claim 17, wherein the I-beam further comprises two end members positioned at opposite ends of said I-beam, said two end members extending an equal predetermined distance downwardly from the lower flange to thereby provide two legs to support the lifting beam upright upon a surface.

* * * * *